US011434670B2

(12) United States Patent
Yamatozaki

(10) Patent No.: US 11,434,670 B2
(45) Date of Patent: Sep. 6, 2022

(54) ESCUTCHEON AND VEHICLE DOOR

(71) Applicant: KASAI KOGYO CO., LTD., Kanagawa (JP)

(72) Inventor: Toru Yamatozaki, West Bloomfield, MI (US)

(73) Assignee: KASAI KOGYO CO., LTD., Kanagawa (JP)

( * ) Notice: Subject to any disclaimer, the term of this patent is extended or adjusted under 35 U.S.C. 154(b) by 212 days.

(21) Appl. No.: 16/763,022

(22) PCT Filed: Feb. 6, 2018

(86) PCT No.: PCT/JP2018/004041
§ 371 (c)(1),
(2) Date: May 11, 2020

(87) PCT Pub. No.: WO2019/155528
PCT Pub. Date: Aug. 15, 2019

(65) Prior Publication Data
US 2020/0300005 A1 Sep. 24, 2020

(51) Int. Cl.
*E05B 79/06* (2014.01)
*E05B 85/12* (2014.01)

(52) U.S. Cl.
CPC ..... *E05B 79/06* (2013.01); *E05B 85/13* (2013.01); *E05Y 2900/531* (2013.01); *Y10T 292/57* (2015.04)

(58) Field of Classification Search
CPC ..... E05B 79/00; E05B 79/02; E05B 79/06; E05B 85/12; E05B 85/13; E05B 3/06; E05B 15/02; E05B 2015/1657; Y10T 292/57
See application file for complete search history.

(56) References Cited

U.S. PATENT DOCUMENTS 6,712,329 B2 * 3/2004 Ishigami ..... B60R 1/06 248/475.1
8,408,611 B2 * 4/2013 Takagai ..... E05B 77/04 292/DIG. 41

(Continued)

FOREIGN PATENT DOCUMENTS

CN 104968517 A 10/2015
CN 108505849 A * 9/2018

(Continued)

OTHER PUBLICATIONS

International Search Report for International Application No. PCT/JP2018/004041 dated Apr. 10, 2018, Japan, 1 page.

*Primary Examiner* — Carlos Lugo
(74) *Attorney, Agent, or Firm* — United IP Counselors, LLC

(57) ABSTRACT

An escutcheon and a vehicle door which attain excellent door interior design are provided. An escutcheon includes: a first vertical wall part covering the circumference of a handle base vertical wall part having a shape of a frame; a second vertical wall part having a shape of a frame continuous in a circumferential direction along a handle opening, the second vertical wall part having its height set corresponding to a clearance between a projecting end of the handle base vertical wall part and a back surface of the door trim; and a continuous part connecting between the first vertical wall part and the second vertical wall part.

5 Claims, 5 Drawing Sheets

(56) References Cited

U.S. PATENT DOCUMENTS

| | | | | |
|---|---|---|---|---|
| 8,511,707 | B2 * | 8/2013 | Amamori | B60R 21/2035 280/728.2 |
| 9,045,920 | B2 * | 6/2015 | Minemura | E05B 79/06 |
| 9,248,722 | B2 * | 2/2016 | Gillay | E05B 85/02 |
| 9,863,454 | B2 * | 1/2018 | Morris | B60R 11/00 |
| 10,458,161 | B2 * | 10/2019 | Kunimatsu | E05B 79/06 |
| 2008/0073919 | A1 * | 3/2008 | Soda | E05B 41/00 292/336.3 |
| 2016/0010368 | A1 | 1/2016 | Tanoguchi et al. | |

FOREIGN PATENT DOCUMENTS

| | | | | |
|---|---|---|---|---|
| JP | H05-098852 | A | | 4/1993 |
| JP | H06193330 | A | * | 7/1994 |
| JP | 2000-087602 | A | | 3/2000 |
| JP | 2001207695 | A | * | 8/2001 |
| JP | 3293468 | B2 | * | 6/2002 |
| JP | 2007009478 | A | * | 1/2007 |
| JP | 2008-014089 | A | | 1/2008 |
| KR | 20020046048 | A | * | 6/2002 |
| WO | 2014/122835 | A1 | | 8/2014 |

* cited by examiner

ESCUTCHEON AND VEHICLE DOOR

CROSS-REFERENCE TO RELATED APPLICATIONS

This application is a National Stage Entry application of PCT International Application No. PCT/JP2018/004041, filed on Feb. 6, 2018, the entire contents of which are hereby incorporated by reference.

BACKGROUND

1. Technical Field

The present invention relates to an escutcheon and a vehicle door.

2. Description of the Background

For example, Japanese Unexamined Patent Application Publication No. 2000-87602 (hereinafter referred to as "Patent Literature 1") discloses a vehicle interior door handle device which includes a casing pivotally supporting an interior door handle. The casing is mounted on an inner panel so as to project from an opening at a door trim which covers the inner surface of the inner panel of a vehicle door. The vehicle interior door handle device further includes a decorative frame called the escutcheon, which is disposed at the opening of the door trim.

For example, Japanese Unexamined Patent Application Publication No. 5-98852 (hereinafter referred to as "Patent Literature 2") discloses an interior door handle mount structure in which a door trim and a bezel (also referred to as an escutcheon) are mounted on an inner panel of a vehicle door from the cabin side. The mount structure includes, on the cabin side of the inner panel, an interior door handle base which pivotally, supports an interior door handle.

BRIEF SUMMARY

Here, in the schemes disclosed in Patent Literatures 1, 2, the cabin-side end of the escutcheon has the shape of a flange which extends outward in the surface direction of the door trim. To the user looking at the door trim in the cabin, such an escutcheon is obtrusive and annoying.

The present invention has been made in view of the circumstances, and an object thereof is to provide an escutcheon and a vehicle door which attain excellent door interior design.

In order to solve the problem, a first inventive aspect is an escutcheon configured to mount a handle base pivotally supporting an interior door handle on a door trim including a handle opening, the escutcheon including: a first vertical wall part covering a circumference of a handle base vertical wall part having a shape of a frame; a second vertical wall part having a shape of a frame continuous in a circumferential direction along the handle opening, the second vertical wall part having its height set corresponding to a clearance between a projecting end of the handle base vertical wall part and a back surface of the door trim; and a continuous part connecting between the first vertical wall part and the second vertical wall part.

The present invention further preferably includes: a first engaging part configured to engage with a first hook part disposed in an outer circumference of the handle base vertical wall part so that the handle base is mounted on the escutcheon, and a second engaging part configured to engage with a second hook part provided around the handle opening on the back surface of the door trim so that the escutcheon is mounted on the door trim.

In the present invention, the projecting end of the second vertical wall part is preferably set to abut on the back surface of the door trim.

In the present invention, the second vertical wall part is preferably set to become flush with the handle base vertical wall part.

A second inventive aspect relates to a vehicle door including: a door trim configured to cover a door panel on a cabin side and includes a handle opening; an interior door handle device including a handle base pivotally supporting an interior door handle for a user in the cabin to manipulate for opening and closing a door; and the escutcheon according to the first inventive aspect.

In the present invention, a surface member covering a surface of a core member of the door trim is preferably bonded as being folded back on a back surface side from an edge of the handle opening.

The present invention provides an escutcheon and a vehicle door which attain excellent door interior design.

DETAILED DESCRIPTION

Figure 1:
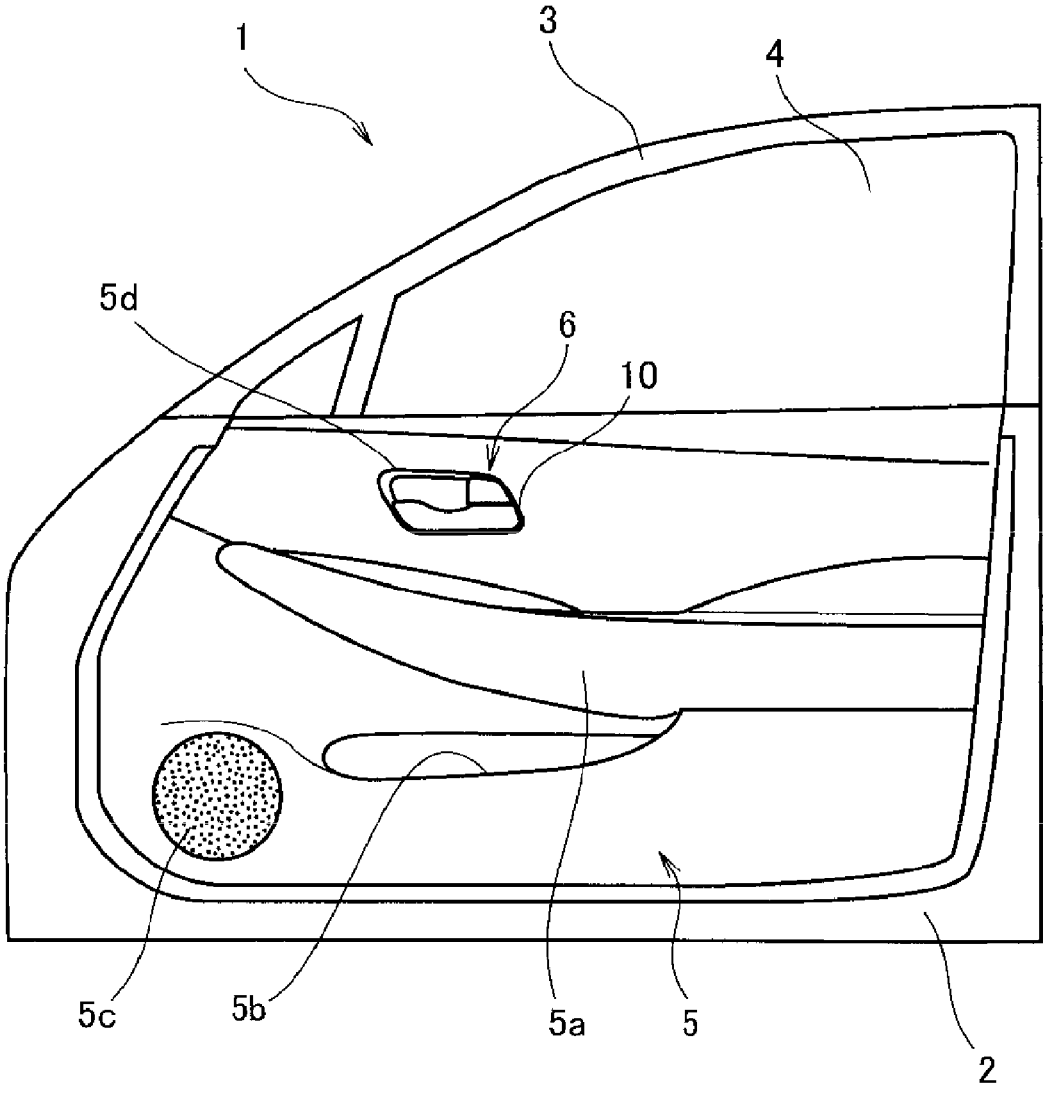
FIG. 1 is a front view schematically showing the structure of a side door.
Figure 2:
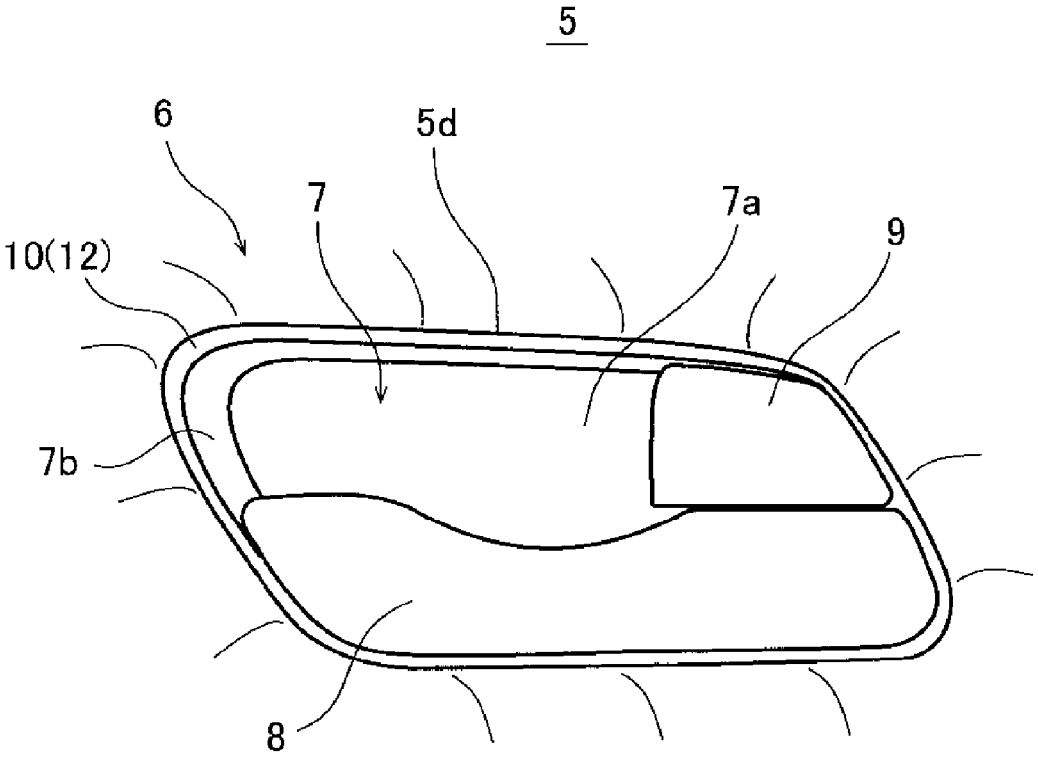
FIG. 2 is a front view of the main part of the side door in an enlarged manner.
Figure 3:
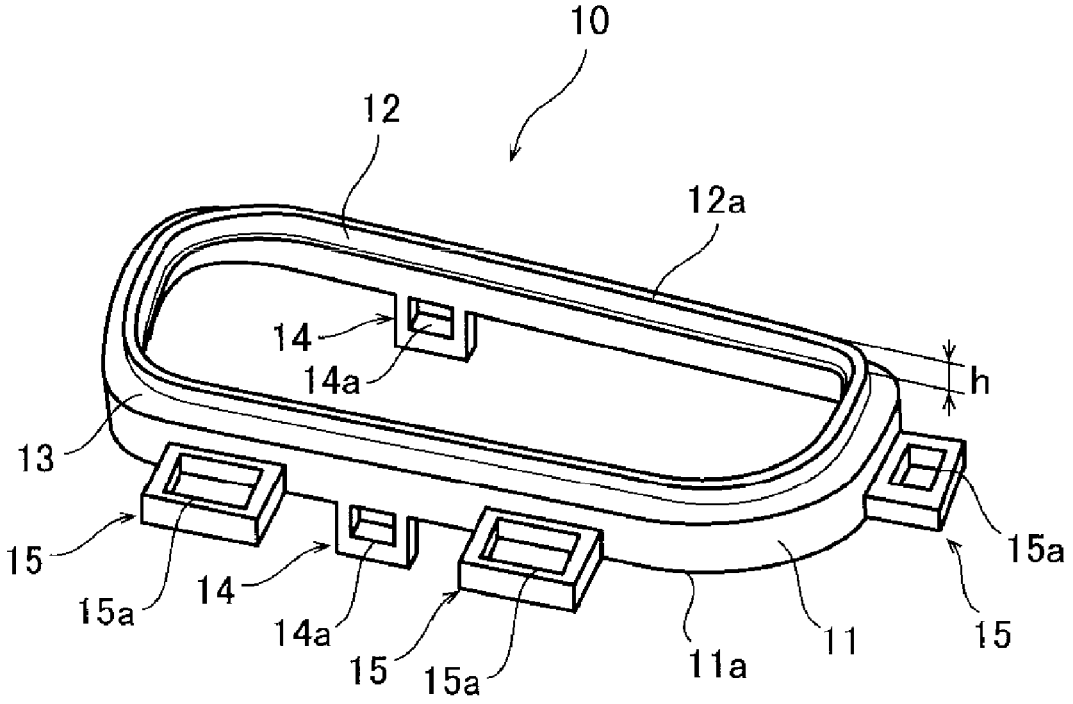
FIG. 3 is an explanatory view of the structure of an escutcheon.
Figure 4:
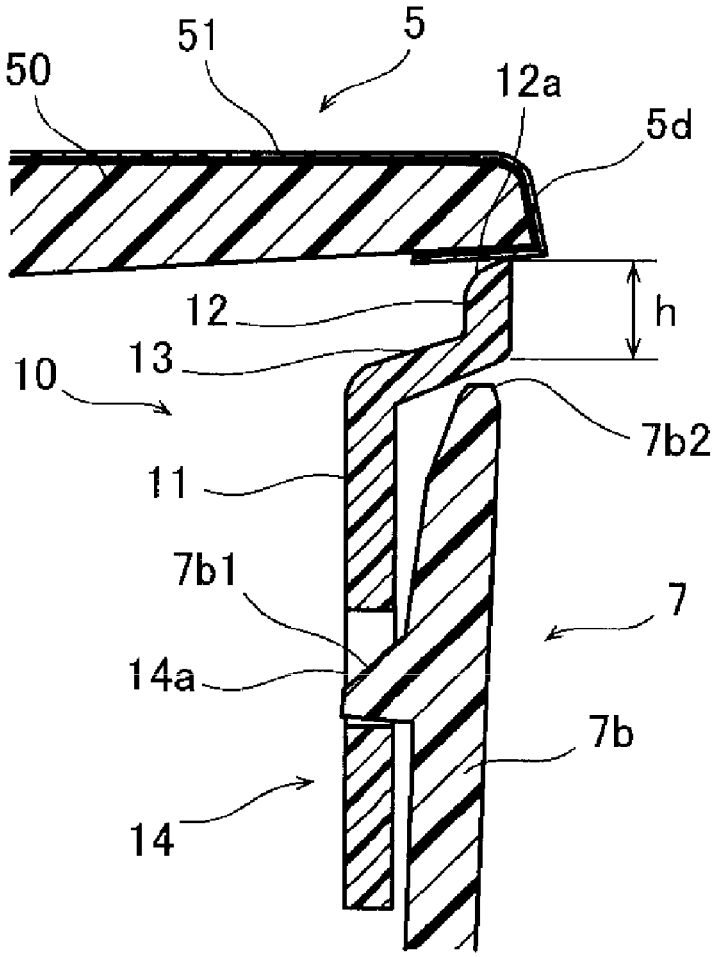
FIG. 4 is an explanatory view schematically showing the cross-sectional structure of the side door.
Figure 5:
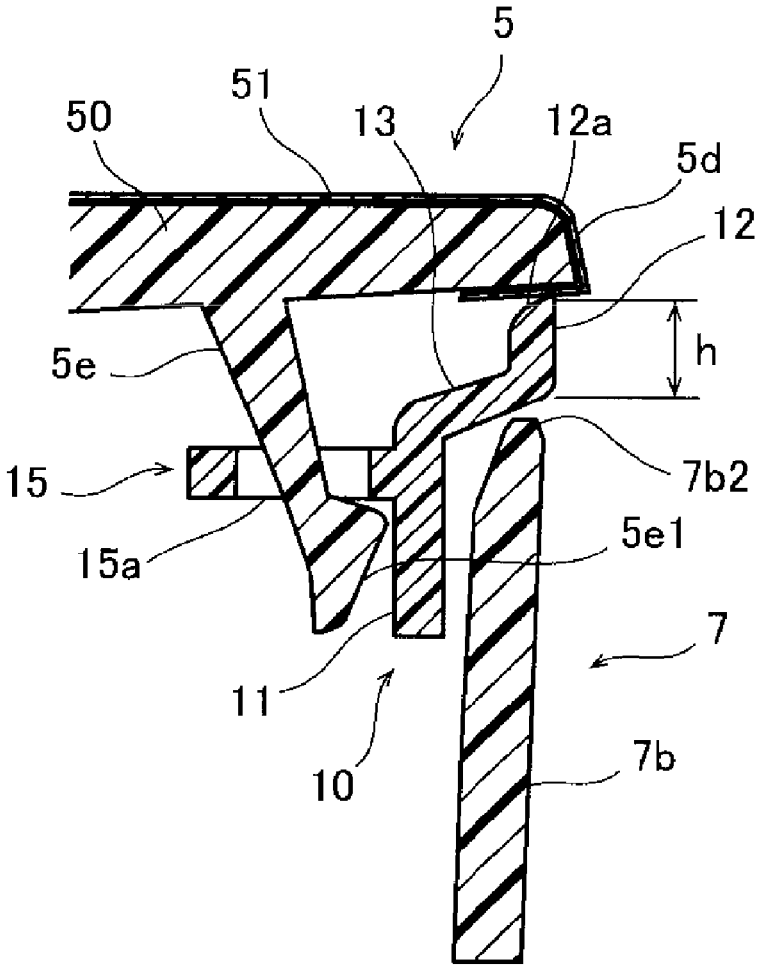
FIG. 5 is an explanatory view schematically showing the cross-sectional structure of the side door.

In the following, a description will be exemplarily given of a side door 1 as a vehicle door according to the present embodiment. Here, FIG. 1 is a front view schematically showing the structure of the side door 1. FIG. 2 is a front view of the main part of the side door 1 in an enlarged manner. FIG. 3 is an explanatory view of the structure of an escutcheon 10. FIGS. 4 and 5 are each an explanatory view schematically showing the cross-sectional structure of the side door 1.

The side door 1 is, for example, a front side door configured to open and close a door opening between a front pillar and a center pillar. The side door 1 has its front end coupled to the vehicle body via a hinge mechanism (not shown), so as to be rotatable about the hinge mechanism. The side door 1 is mainly formed of a door body 2, a door sash 3, a door trim 5, an interior door handle device 6, and an escutcheon 10.

The door body 2 includes a door outer panel which is the outer half of the door, and a door inner panel which is the inner half of the door. The door outer panel and the door inner panel have their respective edges bonded to each other, thereby forming closed space between them.

The door sash 3 is provided at an upper part of the door body 2, to guide vertical shifting of the door window 4.

The door trim 5 is an interior component for decorating the interior, and provided on the cabin side of the door body 2 (the door inner panel) to cover the door body 2. The main part of the door trim 5 has a surface shape extending in the top-bottom direction. The door trim 5 is made up of a core member 50 which is manufactured through die molding using any appropriate synthetic resin material, and a surface member 51 bonded to the surface of the core member 50.

At the center in the top-bottom direction of the door trim 5, a door armrest 5*a* is provided. The door trim 5 is provided with a door pocket 5*b* at a position lower than the door armrest 5*a*. On the front side of the door pocket 5*b*, a speaker grille 5*c* is provided. Above the door armrest 5*a*, a handle opening 5*d* is provided for exposing the interior door handle device 6 disposed on the back surface side of the door trim 5 in the cabin.

The handle opening 5*d* is bored at the door trim 5 in a prescribed shape corresponding to the interior door handle device 6 (specifically, a projecting end 7*b*2 of a handle base vertical wall part 7*b* which will be described later). In the surface member 51 covering the front surface of the core member 50, the end corresponding to the handle opening 5*d* is bonded as being folded back to the back surface side from the edge of the handle opening 5*d* by wrapping work.

Around the handle opening 5*d* on the back surface side of the door trim 5, projection parts 5*e* for mounting the escutcheon 10 on the door trim 5 are provided in an erect manner. A plurality of projection parts 5*e* are provided in the circumferential direction of the handle opening 5*d*. At the chip of each projection part 5*e*, a hook part (second hook part) 5*e*1 for engaging with the escutcheon 10 is provided.

The interior door handle device 6 is mainly composed of a handle base 7, an interior door handle 8, and a lock knob 9. The interior door handle device 6 is disposed so as to correspond to the handle opening 5*d* provided at the door trim 5.

The handle base 7 forms prescribed space for housing the interior door handle 8 and the lock knob 9, and for allowing the user to manipulate the interior door handle 8. The handle base 7 includes a plate-like bottom plate part 7*a* extending in the top-bottom direction, and a vertical wall part (hereinafter referred to as "the handle base vertical wall part") 7*b* which has the shape of a frame continuously provided along the circumferential edge of the bottom plate part 7*a*. The handle base 7 is mounted on the back surface side of the door trim 5 via the escutcheon 10 so that the interior door handle 8 and the lock knob 9 are exposed in the cabin. In the outer circumference of the handle base vertical wall part 7*b*, a plurality of projecting hooks (first hook parts) 7*b*1 for engaging with the escutcheon 10 are provided in the circumferential direction.

The interior door handle 8 is a manipulation member for the user to manipulate for opening the side door 1. The interior door handle 8 is disposed at a lower level in the handle base 7, and pivotally supported on the handle base 7. The interior door handle 8 rotates between the closed position where it is housed in the handle base 7, and the open position which is a predetermined position on the cabin side reached by the rotated interior door handle 8. The interior door handle 8 is connected to a door lock device E, not shown) disposed in the side door 1 via a not-shown cable or the like.

When the interior door handle 8 is in the closed position, the engaged state where the latch part of the door lock device engages with the vehicle body is entered. Accordingly, the side door 1 maintains the closed state. On the other hand, when the interior door handle 8 is rotated to reach the open position, the door lock device is operated to cancel the engaged state between the latch part and the vehicle body. Thus, the side door 1 can be opened.

The lock knob 9 is a manipulation member which is manipulated by the user for regulating opening of the side door 1. The lock knob 9 is disposed at an upper level in the handle base 7, and pivotally supported on the handle base 7. The lock knob 9 rotates between the closed position where it is housed in the handle base 7, and the open position which is a predetermined position on the cabin side reached by the rotated lock knob 9. The lock knob 9 is connected to the door lock device disposed in the side door 1 via a not-shown cable or the like.

When the lock knob 9 is in the closed position, the door lock device is in the unlocked state where any manipulation on the interior door handle 8 is effective. In this case, the user can freely open the side door 1 by manipulating the interior door handle 8. On the other hand, when the lock knob 9 is rotated to reach the open position, the door lock device enters the locked state where any manipulation on the interior door handle 8 is ineffective. In the locked state, since any manipulation on the interior door handle 8 is ineffective, the opening of the side door 1 is regulated.

The escutcheon 10 is a member for mounting the handle base 7 on the door trim 5. The escutcheon 10 is disposed so as to correspond to the handle opening 5*d* on the back surface side of the door trim 5, and mounted on the door trim 5 by the hook parts 5*e*1 of the projection parts 5*e*. The handle base 7 is mounted on the inner side of the escutcheon 10.

The escutcheon 10 is formed of a first vertical wall part 11, a second vertical wall part 12, and a continuous part 13.

The first vertical wall part 11 has the shape of a frame covering the circumference of the handle base vertical wall part 7*b*. The second vertical wall part 12 is positioned on the door trim 5 side than the first vertical wall part 11, and has the shape of a frame continuous in the circumferential direction along the handle opening 5*d*. While the handle opening 5*d* has the shape corresponding to the projecting end 7*b*2 of the handle base vertical wall part 7*h*, the second vertical wall part 12 has the shape corresponding also to the projecting end 7*b*2 of the handle base vertical wall part 7*b*. The dimension of the second vertical wall part 12 is inwardly smaller than that of the first vertical wall part 11 so that a step height is formed between the second vertical wall part 12 and the first vertical wall part 11. The continuous part 13 functions to integrally connect between the first vertical wall part 11 and the second vertical wall part 12.

In the escutcheon 10, the second vertical wall part 12 has its height h set corresponding to the clearance between the projecting end 7*b*2 of the handle base vertical wall part 7*b* and the back surface of the door trim 5. Accordingly, in the state where the escutcheon 10 is mounted door trim 5, the projecting end 12*a* of the second vertical wall part 12 abuts on the back surface of the door trim 5.

At the projecting end 11*a* of the first vertical wall part 11 (that is, the external-side end of the escutcheon 10), first caught parts 14 with which the projecting hooks 7*b*1 of the handle base vertical wall part 7*b* respectively engage are provided. The first caught parts 14 are each formed as an extending piece which extends toward the external side along the first vertical wall part 11. At the center of each first caught part 14, an engagement hole 14*a* with which the projecting hook 7*b*1 engages is formed. A plurality of first caught parts 14 are provided in the circumferential direction of the first vertical wall part 11 so as to correspond to the projecting hooks 7*b*1.

In the outer circumference of the first vertical wall part 11, second caught parts 15 are provided in an erect manner, with which the hook parts 5*e*1 of the projection parts 5*e* provided on the back surface side of the door trim 5 respectively engage. The second caught parts 15 are each formed as an extending piece which extends outward and perpendicularly from the first vertical wall part 11. At the center of each second caught part 15, an engagement hole 15*a* with which the hook part 5*e*1 engages is formed. A plurality of second caught parts 15 are provided in the circumferential direction of the first vertical wall part 11 so as to correspond to the projection parts 5*e*.

In relation to the side door 1 structured as described above, the handle base 7 is mounted on the door trim 5 via the escutcheon 10. Specifically, firstly, the escutcheon 10 is put on the back surface side of the door trim 5 having the second vertical wall part 12 set on the back surface side of the door trim 5. Then, the handle opening 5*d* and the escutcheon 10 are aligned with each other. Until the projecting end 12*a* of the second vertical wall part 12 abuts on the back surface of the door trim 5, the escutcheon 10 is advanced toward the back surface side of the door trim 5. Here, by the tip of the projection parts 5*e* respectively entering the engagement holes 15*a* of the second caught parts 15, the hook parts 5*e*1 of the projection parts 5*e* and the second caught parts 15 engage with each other. This engaged state completes the mounting the escutcheon 10 on the door trim 5.

Next, the handle base 7 which pivotally supports the interior door handle 8 and the lock knob 9 is put on the back surface side of the door trim 5, and aligned with the escutcheon 10. Here, the handle base 7 is disposed so that the interior door handle 8 and the lock knob 9 are exposed in the cabin. Then, the handle base 7 is advanced toward the escutcheon 10, and inserted into the first vertical wall part 11 of the escutcheon 10. Thus, the projecting end 7*b*2 of the handle base vertical wall part 7*b* abuts on the portion connecting between the second vertical wall part 12 and the continuous part 13 in the escutcheon 10. In this insertion procedure, the projecting hooks 7*b*1 of the handle base vertical wall part 7*b* respectively enter the engagement holes 14*a* of the first caught parts 14 of the escutcheon 10, to engage with the first caught parts 14. This engaged state completes the mounting the handle base 7 on the escutcheon 10. In this case, the second vertical wall part 12 has the frame shape corresponding to the projecting end 7*b*2 of the handle base vertical wall part 7*b*. Accordingly, the second vertical wall part 12 of the escutcheon 10 becomes flush with the handle base vertical wall part 7*b*, and the second vertical wall part 12 and the handle base vertical wall part 7*b* are neatly juxtaposed to each other.

Through the series of steps, the door trim 5 and the handle base 7 are mounted on each other via the escutcheon 10. In the mounting procedure, the handle base 7 may be previously mounted on the escutcheon 10, and then the escutcheon 10 may be mounted on the door trim 5.

In this manner, in the present embodiment, the escutcheon 10 includes: the first vertical wall part 11 having the shape of a frame covering the circumference of the handle base vertical wall part 7*b*; the second vertical wall part 12 having the shape of a frame continuous in the circumferential direction along the handle opening 5*d*, and having its height h set corresponding to the clearance between the projecting end 7*b*2 of the handle base vertical wall part 7*b* and the back surface of the door trim 5; and the continuous part 13 connecting between the first vertical wall part 11 and the second vertical wall part 12.

In this structure, the escutcheon 10 is entirely housed on the back surface side of the door trim 5. This avoids the escutcheon 10 from obtrusively appearing on the surface of the door trim 5 to the user looking at the door trim 5 in the cabin. Thus, the door interior design improves.

The escutcheon 10 according to the present embodiment can be mounted from the back surface side of the door trim 5. By virtue of the escutcheon 10 and the handle base 7 being mounted from the identical direction, workability improves. Furthermore, by virtue of the clearance between the projecting end 7*b*2 and the back surface of the door trim 5 being complemented by the height h of the second vertical wall part 12, the handle base 7 does not require any particular design change. This allows use of general components, and improves flexibility in designing the interior door handle device 6.

In the present embodiment, the escutcheon 10 includes: the first caught part (first engaging part) 14 configured to engage with the projecting hook 7*b*1 disposed in the outer circumference of the handle base vertical wall part 7*b* so that the handle base 7 is mounted on the escutcheon 10; and the second caught part (second engaging part) 15 configure to engage with the hook part 5*e*1 provided at the back surface of the door trim 5 so that the escutcheon 10 is mounted on the door trim 5.

In this structure, the engaging function working on the back surface side of the door trim 5 allows the escutcheon 10 to be properly mounted from the back surface side of the door trim 5.

In the present embodiment, the projecting end 12*a* of the second vertical wall part 12 is set to abut on the back surface of the door trim 5.

In this structure, the escutcheon 10 is positioned on the back surface side of the door trim 5, avoiding the escutcheon 10 from obtrusively appearing in the cabin. Thus, the door interior design improves.

In the present embodiment, the handle base vertical wall part 7*b* and the second vertical wall part 12 are flush to each other.

In this structure, the handle base 7 and the escutcheon 10 being continuous to each other provide a neatly finished appearance.

In the present embodiment, the surface member 51 which covers the surface of the core member 50 of the door trim 5 is bonded as being folded back an the back surface side from the edge of the handle opening 5*d*.

In this structure, the end of the surface member 51 is hidden on the back surface side of the door trim 5. Furthermore, also in the case where a slit is formed at the end of the surface member 51 so as to conform to the shape of the handle opening 5*d*, the end including the slit being folded back on the back surface side avoids the slit from becoming exposed in the cabin. This provides a neatly finished appearance.

The foregoing is the description of the vehicle door according to the present embodiment. Without being limited to the embodiment, various changes may be made within the scope of the present invention. Not only the vehicle door, but also the escutcheon of the vehicle door itself also holds as part of the present invention.

REFERENCE SIGNS LIST

1 side door
2 door body
3 door sash
4 door window
5 door trim
5*a* door armrest
5*b* door pocket
5*c* speaker grille
5*d* handle opening

5*e* projection part
5*e*1 hook part
6 interior door handle device
7 handle base
7*a* bottom plate part
7*b* handle base vertical wall part
7*b*1 projecting hook
7*b*2 projecting end
8 interior door handle
9 lock knob
10 escutcheon
11 first vertical wall part
11*a* projecting end
12 second vertical wall part
12*a* projecting end
13 continuous part
14 first caught part
14*a* engagement hole
15 second caught part
15*a* engagement hole
50 core member
51 surface member

The invention claimed is:

1. An escutcheon configured to mount a handle base pivotally supporting an interior door handle on a door trim including a handle opening, the escutcheon comprising:

a first vertical wall part covering a circumference of a handle base vertical wall part having a shape of a frame;

a second vertical wall part having a shape of a frame continuous in a circumferential direction along the handle opening, the second vertical wall part having its height set corresponding to a clearance between a projecting end of the handle base vertical wall part and a back surface of the door trim; and a continuous part connecting between the first vertical wall part and the second vertical wall part, wherein the second vertical wall part is set to become flush with the handle base vertical wall part, and a projecting end of the second vertical wall part is set to abut on the back surface of the door trim.

2. The escutcheon according to claim 1, further comprising:

a first engaging part configured to engage with a first hook part disposed in an outer circumference of the handle base vertical wall part so that the handle base is mounted on the escutcheon; and a second engaging part configured to engage with a second hook part provided around the handle opening on the back surface of the door trim so that the escutcheon is mounted on the door trim.

3. A vehicle door comprising:

a door trim configured to cover a door panel on a cabin side and includes a handle opening;

an interior door handle device including a handle base pivotally supporting an interior door handle for a user in the cabin to manipulate for opening and closing a door; and the escutcheon according to claim 1.

4. The vehicle door according to claim 3, wherein a surface member covering a surface of a core member of the door trim is bonded as being folded back on a back surface side from an edge of the handle opening.

5. A vehicle door comprising:

a door trim configured to cover a door panel on a cabin side and includes a handle opening;

an interior door handle device including a handle base pivotally supporting an interior door handle for a user in the cabin to manipulate for opening and closing a door; and the escutcheon according to claim 2.

* * * * *